US012492051B2

(12) United States Patent
Duke

(10) Patent No.: US 12,492,051 B2
(45) Date of Patent: Dec. 9, 2025

(54) FOOD CONTAINER WITH CONDIMENT COMPARTMENT

(71) Applicant: Leslie P. Duke, Lindale, GA (US)

(72) Inventor: Leslie P. Duke, Lindale, GA (US)

( * ) Notice: Subject to any disclaimer, the term of this patent is extended or adjusted under 35 U.S.C. 154(b) by 0 days.

(21) Appl. No.: 18/198,001

(22) Filed: May 16, 2023

(65) Prior Publication Data

US 2024/0383655 A1 Nov. 21, 2024

(51) Int. Cl.
*B65D 51/28* (2006.01)
*B65D 5/00* (2006.01)

(52) U.S. Cl.
CPC ..... *B65D 51/28* (2013.01); *B65D 5/0085* (2013.01)

(58) Field of Classification Search
CPC ..... B65D 1/36; B65D 51/28; B65D 5/0085; B65D 3/24; B65D 5/4237; B65D 5/4241; B65D 5/48004; B65D 5/48026; B65D 7/065; B65D 27/08; B65D 31/12
See application file for complete search history.

(56) References Cited

U.S. PATENT DOCUMENTS

| | | | | |
|---|---|---|---|---|
| 5,205,476 | A * | 4/1993 | Sorenson | B65D 5/667 229/148 |
| 5,890,648 | A * | 4/1999 | Cai | B65D 5/48018 229/148 |
| 5,909,840 | A | 6/1999 | Schultheiss | |
| 6,543,679 | B2 | 4/2003 | Cai et al. | |
| 6,588,652 | B2 | 7/2003 | Cai | |
| 7,464,855 | B2 * | 12/2008 | Glasgow | B65D 5/6626 229/906 |
| 8,490,808 | B1 * | 7/2013 | Snyder | B65D 5/667 220/4.23 |
| 11,059,621 | B2 | 7/2021 | Nowak et al. | |

* cited by examiner

*Primary Examiner* — Kareen K Thomas
(74) *Attorney, Agent, or Firm* — Baker, Donelson, Bearman, Caldwell & Berkowitz, PC

(57) ABSTRACT

A food container with condiment compartment has bottom portion, and a top portion, and a hinge portion. The bottom portion includes a bottom panel, two oppositely disposed sidewall panels, a front panel, and a rear panel. The top portion includes a top panel, two oppositely disposed sidewall panels, a front panel, and a rear panel. The hinge portion has a first trough panel extending from the rear panel of the bottom portion, and a second trough panel extending from the rear panel of the top portion. The hinge portion also has two oppositely disposed end panels that are joined to the first trough panel and joined to the second trough panel. The combination of the first trough panel, the second trough panel, and the two end panels forms a condiment compartment or open trough positioned between the bottom portion and the top.

2 Claims, 4 Drawing Sheets

FOOD CONTAINER WITH CONDIMENT COMPARTMENT

CROSS REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present inventive concept relates to the field of food containers. More particularly, the invention relates to a food container having a condiment compartment.

Technology in the Field of the Invention

Many fast foods, such as hamburgers, French fries, chicken sandwiches, tacos, chick fingers, and the like, are served by fast food restaurants in paperboard containers. These containers typically includes a bottom tray or portion and a top cover or portion that is hinged coupled to the bottom tray along a common fold line.

Many of these foods are eaten with condiments such as ketchup, mustard, special sauces, and the like. The problem is that while eating in a car or on the move it is difficult to use these condiments with the food as there is no separation between the food item and the condiment. Therefore, a person sometimes skips the use of the condiment and must settle for eating the food item without such.

Accordingly, a need exists for a food container having the capability of holding condiments separate from the food item. It is to the provision of such therefore that the present invention is primarily directed.

BRIEF SUMMARY OF THE INVENTION

A food container comprises a first portion having a bottom panel, two oppositely disposed first sidewall panels, a first front panel, and a first rear panel, a second portion having a top panel, two oppositely disposed second sidewall panels, a second front panel, and a second rear panel, and a hinge portion coupled to the first portion along a first fold line and coupled to the second portion along a second fold line for pivotal movement of the second portion relative to the first portion between a closed configuration wherein the second portion is in register with the first portion and an open configuration wherein the second portion is not in registered with the first portion, the hinge portion forming an open trough when the second portion is positioned in its open configuration.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
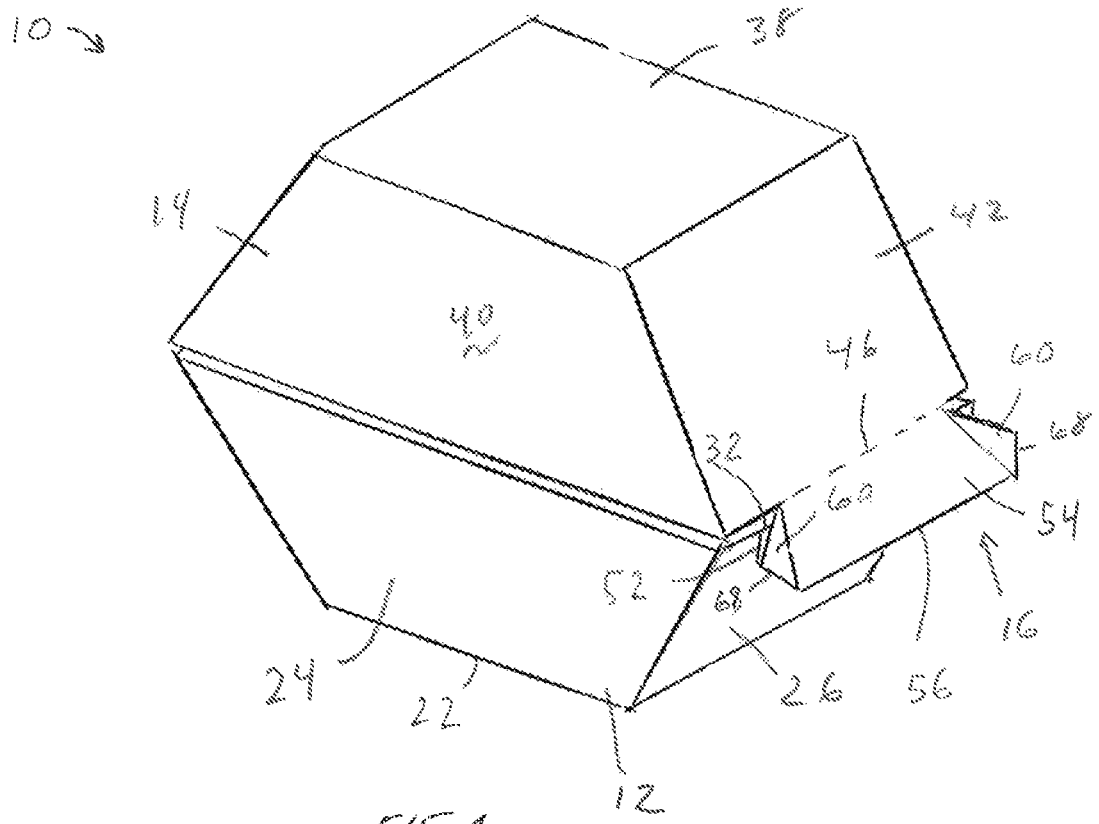
FIG. 1 is a perspective view of a food container with condiment compartment embodying principles of the invention in a preferred form, shown in a closed configuration.

For purposes of the present disclosure, it is noted that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Description of Selected Specific Embodiments

With reference next to the drawings, there is a shown a food container with condiment compartment 10 in a preferred form of the present invention, hereinafter references simply as food container 10.

The food container 10 includes a tray, first or bottom portion 12 and a cover, second or top portion 14. The top portion 14 is coupled to the bottom portion 12 along a hinge or hinge portion 16.

The bottom portion 12 includes a bottom panel 22, two oppositely disposed sidewall panels 24 extending from the bottom panel 22, a front panel 26 extending from the bottom panel 22, and a rear panel 28 extending from the bottom panel 22. The rear panel 28 is coupled to the hinge portion 16 along a first fold or fold line 32. The front panel 26 may include a tab slot 34 therein. The term "panel" may be used interchangeably with the words "wall", "side", "portion" or "part".

The top portion 14 includes a top panel 38, two oppositely disposed sidewall panels 40 extending from the top panel 38, a front panel 42 extending from the top panel 38, and a rear panel 44 extending from the top panel 38. The rear panel 44 is coupled to the hinge portion 16 along a second fold or fold line 46. The front panel 42 may include a tab 48 configured to be received within tab slot 34.

The hinge portion 16 has a first trough panel 52 extending from the rear panel 28 of the bottom portion 12 along the first fold 12, and a second trough panel 54 extending from the rear panel 44 of the top portion 14 along the second fold line 46. The first trough panel 52 and second trough panel 54 are joined together along a third fold or fold line 56, the third fold line 56 may also be referenced as a bottom fold. The hinge portion 16 also has two oppositely disposed end panels 60. Each end panel 60 is joined to the first trough panel 52 along a fourth fold or fold line 64 and joined to the second trough panel 54 along a fifth fold or fold line 66. The fourth and fifth fold lines 64 and 66 may be referenced herein as end folds. Each trough end panel 52 and 54 also has a generally central sixth fold or fold line 68 to allow the end panels 52 and 54 to be folded upon themselves. The sixth fold line 68 may be referenced herein as a central fold. The term "central" or "center" used herein does not require the position to be in the exact center and is meant to include a position that is generally within a central area. The combination of the first trough panel 52, the second trough panel 54 and the two end panels 60 forms a condiment compartment or open trough 70 (trough having the top open and all sides enclosed) positioned between the bottom portion 12 and the top portion 14 that acts as a condiment compartment for the storage of condiments when the food container is in an unregistered, open configuration, shown in FIG. 2.

Figure 2:
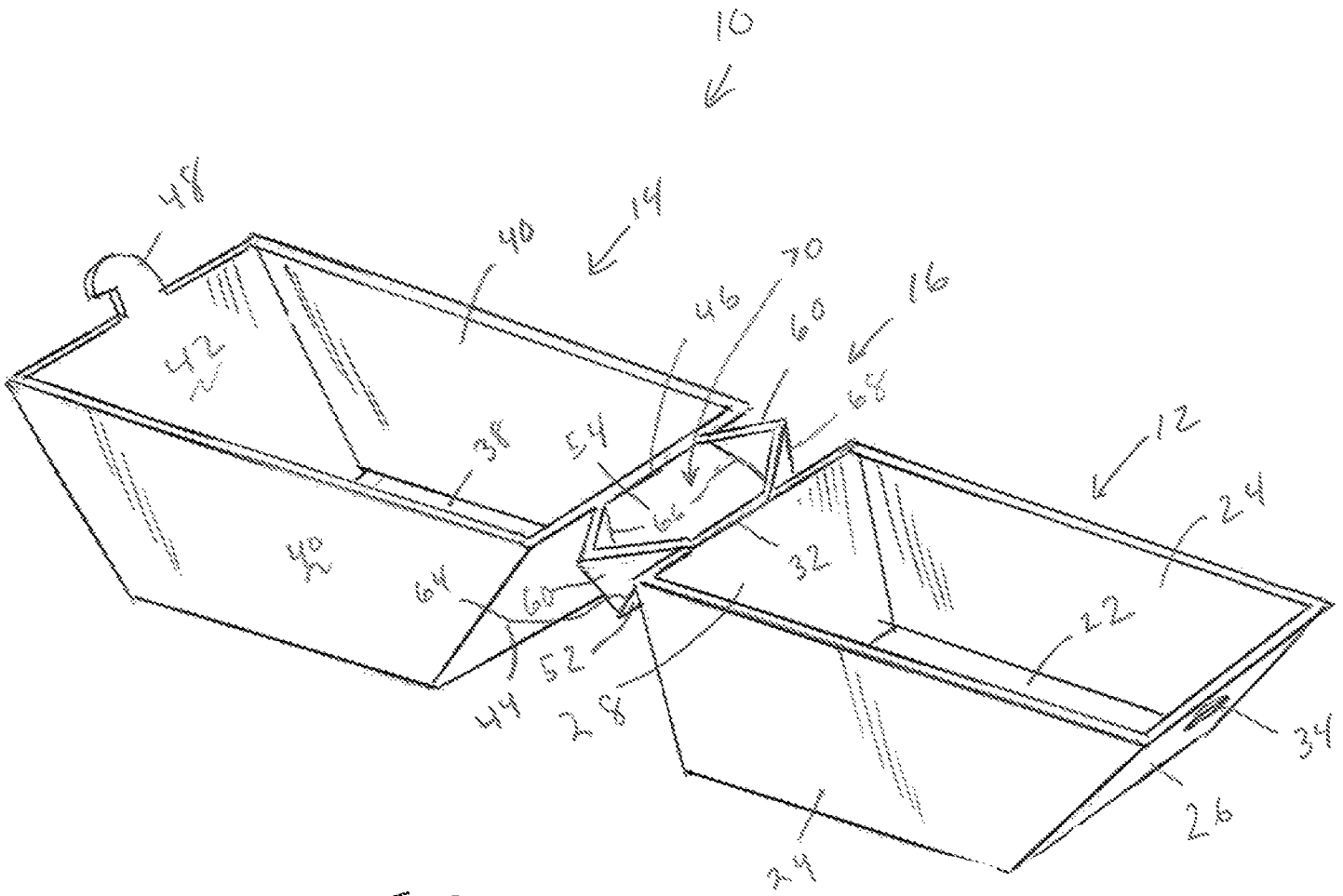
FIG. 2 is a perspective view of a food container with condiment compartment of FIG. 1, shown in an open configuration.

In use, with the food container 10 in an open configuration, shown in FIG. 2, food may be placed within the bottom portion 12 and the top portion 14 is pivoted along fold lines 32, 46 and 56 to its closed position, shown in FIG. 1. The closed configuration being wherein the top portion 14 is in register with the bottom portion 12 so as to essentially close the container to contain the food therein, i.e., the top edges of the sidewall panels 24, front panel 26 and rear panel 28 of the bottom portion 12 are positioned closely to or in register with the bottom edges of the sidewall panels 40, front panel 42 and rear panel 44 of the top portion 14. The tab 48 may then be placed within the tab slot 34 to maintain the food container 10 in its closed configuration. The food container 10 including the food therein may then be presented to the customer.

The customer may subsequently open the food container 10 by pivoting the top portion 14 along fold lines 32, 46 and 56 to an open configuration, shown in FIG. 2. Through the pivoting motion of the top portion 14 relative to the bottom portion 12 the first trough panel 52 and second trough panel 54 pivot away from each other along the third fold line 56, thereby forming the open top condiment trough 70. Simultaneously, the end panels 60 form the ends or end walls of the trough by unfolding or pivoting along the central sixth fold line 68 and pivoting along the fourth and fifth fold lines 64 and 66. Thus, the condiment trough 70 is automatically formed through the opening of the food container without intervention from the consumer.

An added benefit of the present invention is that the condiment compartment or trough 70 does not take space within the food area of the bottom portion 12.

It should be understood that the hinge portion 16 that extends outwardly from the bottom portion 12 and top portion may be adhered to either the bottom or top portion 12, 14 with a weak adhesive so that it may be pulled away if the condiment trough 70 is to be utilized or remain in place if the condiment trough 70 is not to be used, as the hinge portion 16 may still act as a hinge between the bottom portion and top portion when adhered to an adjacent rear wall 28 or 44.

Figure 3:
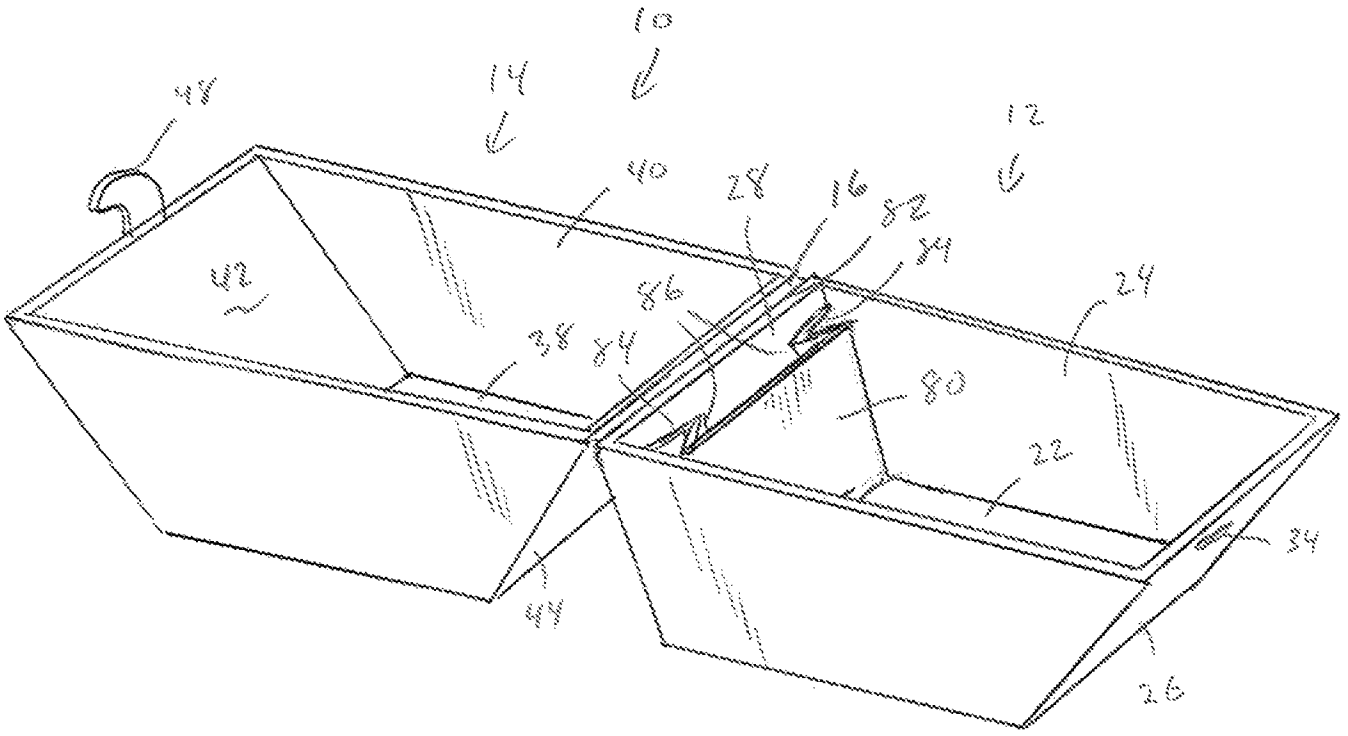
FIG. 3 is a perspective view of a food container embodying principles of the invention in another preferred form, shown in a closed configuration.
Figure 4:
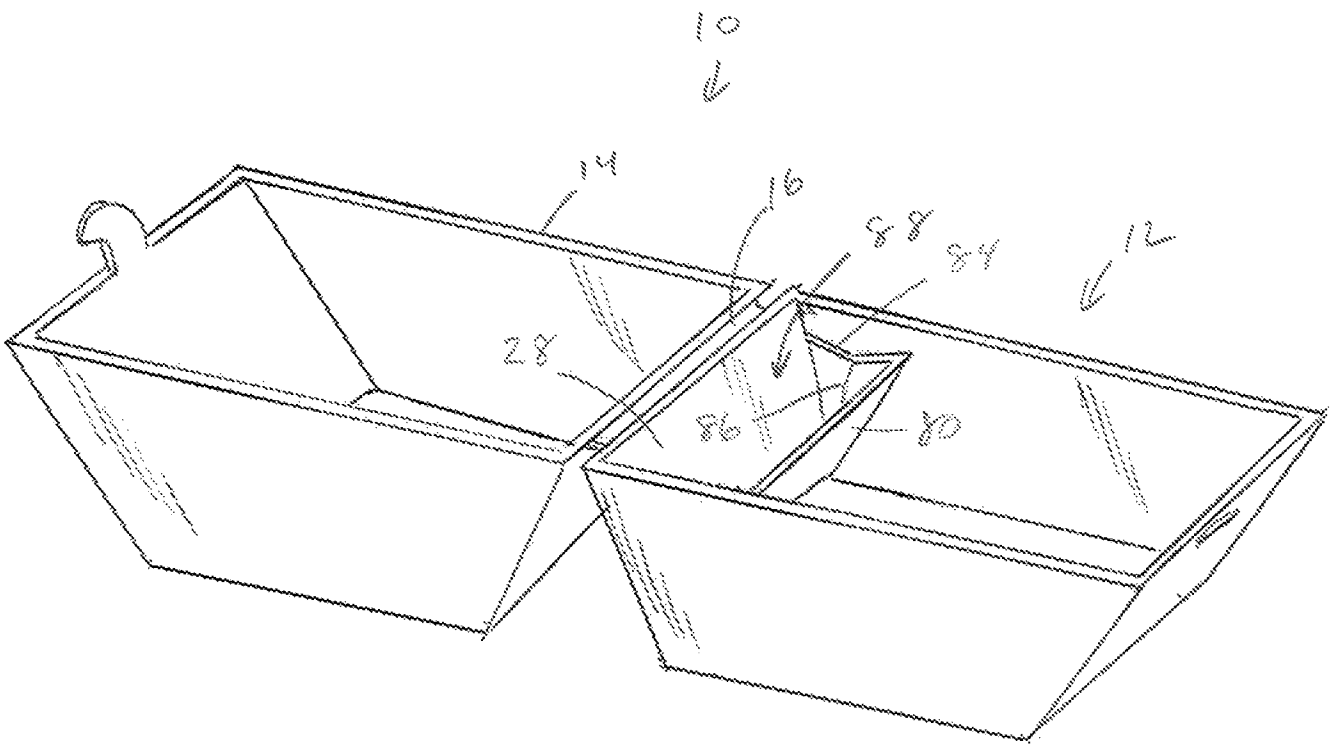
FIG. 4 is a perspective view of the food container of FIG. 3, shown in an open configuration.

With reference next to FIGS. 3 and 4, there is a shown a food container with condiment compartment 10 in another preferred form of the present invention, hereinafter references simply as food container 10.

Here again, the food container 10 includes a tray, first or bottom portion 12 and a cover, second or top portion 14. The top portion 14 is coupled to the bottom portion 12 along a hinge or hinge portion 16.

The bottom portion 12 includes a bottom panel 22, two oppositely disposed sidewall panels 24 extending from the bottom panel 22, a front panel 26 extending from the bottom panel 22, and a rear panel 28 extending from the bottom panel 22. The rear panel 28 is coupled to the hinge portion 16 along a first fold or fold line 32. The front panel 26 may include a tab slot 34 therein.

The top portion 14 includes a top panel 38, two oppositely disposed sidewall panels 40 extending from the top panel 38, a front panel 42 extending from the top panel 38, and a rear panel 44 extending from the top panel 38. The rear panel 44 is coupled to the hinge portion 16 along a second fold or fold line 46. The front panel 42 may include a tab 48 configured to be received within tab slot 34.

The bottom portion 12 includes a central separator or trough panel 80 extending from the rear panel 28 of the bottom portion 12 along the first fold 82. Optionally, the trough panel 80 may be coupled to the bottom panel 22. Two end panels 84 extend from opposite ends of the central trough panel 80 and are each coupled to one sidewall panel 24. Each end panel 84 includes a central fold or fold line 86 that allows the end panel 84 to be folded upon itself. The combination of the sidewall panel 24, end panels 84 and central panel 80 forms a condiment compartment or condiment trough 88.

In use, with the food container 10 in an open configuration, shown in FIGS. 3 and 4, food may be placed within the bottom portion 12 and the top portion 14 is pivoted to its closed position. The closed configuration being wherein the top portion 14 is in register with the bottom portion 12 so as to essentially close the container to contain the food therein, i.e., the top edges of the sidewall panels 24, front panel 26 and rear panel 28 of the bottom portion 12 are positioned closely to the bottom edges of the sidewall panels 40, front panel 42 and rear panel 44 of the top portion 14. The tab 48 may then be placed within the tab slot 34 to maintain the food container 10 in its closed configuration. The food container 10 including the food therein may then be presented to the customer.

The customer may subsequently open the food container 10 by pivoting the top portion 14 along fold lines 32, 46 and 56 to an open configuration, shown in FIG. 3.

The customer may then pivot the trough central panel 80 away from the rear panel 28 so as to open the condiment trough 88. This movement of the trough central panel 80 unfolds the end panels 84 forming an enclosed compartment. The term enclosed compartment means that the compartment is essentially sealed to prevent leaking of the condiment except through the open top, i.e., there are no openings between the trough central panel 80 and the sidewall panels 24.

Once unfolded, a condiment may be poured into the condiment trough 88.

The entire food container 10 may be made of a single sheet of paperboard stock that is cut and folded to form the food container 10 shape shown in the drawings.

The food container 10 is formed so that a plurality of food containers 10 may be nested one within the next to provide a compact stack of food containers.

It thus is seen that a food container is now provided which overcomes problems associated with food containers of the prior art. It should of course be understood that many modifications may be made to the specific preferred embodiment described herein, in addition to those specifically recited herein, without departure from the spirit and scope of the invention as set forth in the following claims.

The invention claimed is:

1. A food container comprising:

a first portion having a bottom panel, two oppositely disposed first sidewall panels, a first front panel, and a first rear panel;

a second portion having a top panel, two oppositely disposed second sidewall panels, a second front panel, and a second rear panel, and a hinge portion coupled to said first portion along a first fold line and coupled to said second portion along a second fold line for pivotal movement of said second portion relative to said first portion between a closed configuration wherein said second portion is in register with said first portion and an open configuration wherein said second portion is not in registered with said first portion, said hinge portion forming an open trough when said second portion is positioned in its open configuration, wherein said hinge portion includes a first trough panel, a second trough panel pivotally coupled to said first trough panel along a third fold line, a first end panel extending between said first trough panel and said second trough panel, and a second end panel extending between said first trough panel and said second trough panel, wherein each said end panel is coupled to said first trough panel along a fourth fold line, and wherein each said end panel is coupled to said second trough panel along a first fold line, wherein each said end panel has a central sixth fold line to allow folding of said end panel upon itself, and wherein the hinge portion is temporarily coupled to the rear wall of either the top portion or bottom portion.

2. A food container comprising:

a bottom portion having a bottom panel, at least four sidewall panels extending from said bottom panel, and a separator panel mounted for pivotal movement between a closed position flush with one said sidewall panel and an open position distal said one sidewall panel;

a top portion having a top panel and at least four sidewall panels extending from said top panel, and a hinge pivotally coupling said top portion to said bottom portion, wherein said separator panel includes a central wall and two oppositely disposed end walls, each said end wall having a central fold line that allows each end wall to be folded upon itself for movement between a folded configuration and an open configuration, the combination of said one sidewall panel, said end walls, and said central wall forming an enclosed compartment.

* * * * *